US009879346B2

(12) United States Patent
Kodama et al.

(10) Patent No.: US 9,879,346 B2
(45) Date of Patent: Jan. 30, 2018

(54) CHROMIUM-AND-FLUORINE-FREE CHEMICAL CONVERSION TREATMENT SOLUTION FOR METAL SURFACES, METAL SURFACE TREATMENT METHOD, AND METAL SURFACE COATING METHOD

(75) Inventors: Takahiro Kodama, Kurashiki (JP); Yasuhiko Nagashima, Tokyo (JP); Noriaki Kobayashi, Tokyo (JP)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 13/331,271

(22) Filed: Dec. 20, 2011

(65) Prior Publication Data

US 2012/0145282 A1 Jun. 14, 2012

Related U.S. Application Data

(63) Continuation of application No. PCT/JP2010/061202, filed on Jun. 30, 2010.

(30) Foreign Application Priority Data

Jul. 2, 2009 (JP) ..... 2009-157682

(51) Int. Cl.

| | |
|---|---|
| ***C23C 22/34*** | (2006.01) |
| ***C23C 22/50*** | (2006.01) |
| ***C23C 22/48*** | (2006.01) |
| ***C23C 22/46*** | (2006.01) |
| ***C23C 22/53*** | (2006.01) |
| ***C23C 22/56*** | (2006.01) |
| *C23C 22/00* | (2006.01) |

(52) U.S. Cl.

CPC ..... *C23C 22/48* (2013.01); *C23C 22/46* (2013.01); *C23C 22/50* (2013.01); *C23C 22/53* (2013.01); *C23C 22/56* (2013.01); *C23C 2222/20* (2013.01)

(58) Field of Classification Search

CPC ..... C23C 22/48; C23C 22/20; C23C 22/34; C23C 22/46; C23C 22/50; C23C 22/53; C23C 22/56

USPC ..... 148/247

See application file for complete search history.

(56) References Cited

U.S. PATENT DOCUMENTS

| | | | | |
|---|---|---|---|---|
| 5,938,861 | A * | 8/1999 | Inoue et al. | 148/247 |
| 6,217,674 | B1 * | 4/2001 | Gray et al. | 148/247 |
| 6,524,403 | B1 * | 2/2003 | Bartlett et al. | 148/247 |
| 7,575,644 | B2 | 8/2009 | Takakuwa et al. | |
| 2006/0185769 | A1 * | 8/2006 | Nakayama et al. | 148/247 |
| 2010/0243465 | A1 * | 9/2010 | Inbe et al. | 205/184 |

FOREIGN PATENT DOCUMENTS

| | | | |
|---|---|---|---|
| JP | 11061431 | A | 3/1999 |
| JP | 2001247977 | A | 9/2001 |
| JP | 2001316845 | A | 11/2001 |
| JP | 2003171778 | A | 6/2003 |
| JP | 2004190121 | A | 7/2004 |
| JP | 2004218071 | A | 8/2004 |
| JP | 2004218072 | A | 8/2004 |
| JP | 2004218074 | A | 8/2004 |
| JP | 2006118012 | A | 11/2006 |
| JP | 2006316342 | A | 11/2006 |
| JP | 2007138258 | A | 6/2007 |
| JP | 2007327090 | A | 12/2007 |
| JP | 2008088551 | A | 4/2008 |
| JP | 2008174832 | A | 7/2008 |
| JP | 2008184620 | A | 8/2008 |
| JP | 2008184630 | A | 8/2008 |
| JP | 2008184690 | A | 8/2008 |
| JP | 2008291345 | A | 12/2008 |

OTHER PUBLICATIONS

International Search Report PCT/JP2010/061202, dated Aug. 10, 2010, 2 pages. All references cited in the International Search Report are listed herein.

* cited by examiner

*Primary Examiner* — Lois Zheng

(74) *Attorney, Agent, or Firm* — Mary K. Cameron

(57) ABSTRACT

Disclosed are: a chemical conversion treatment solution for metal surfaces, which enables the formation of a chemical conversion coating film having excellent corrosion resistance and adhesion properties on metal base materials even though the solution does not contain chromium and fluorine, comprising at least one compound (A) selected from a water-soluble titanium compound and a water-soluble zirconium compound and an organic compound (B) that has multiple functional groups and can serve as a stabilizing agent, and which has a pH value of 2.0 to 6.5, wherein the content of the compound (A) is 0.1 to 10 mmol/L, and the content of the organic compound (B) is 2.5- to 10-fold larger than the content of the metal in the compound (A) by mole; and a method for treating the surface of a metal base material or a structure or body using the chemical conversion treatment solution for metal surfaces.

27 Claims, No Drawings

CHROMIUM-AND-FLUORINE-FREE CHEMICAL CONVERSION TREATMENT SOLUTION FOR METAL SURFACES, METAL SURFACE TREATMENT METHOD, AND METAL SURFACE COATING METHOD

TECHNICAL FIELD

The present invention relates to chemical conversion treatment solutions for metal surfaces used for the improvement of a metallic base material, particularly the surface of a structure made of a metallic base material, in corrosion resistance and coating adhesion. This invention also relates to metal surface treatment methods and metal surface coating methods.

The chemical conversion treatment solution of the present invention is an environmental impact-reducing product because it allows formation of a chemical conversion film with a high corrosion resistance and a good coating adhesion on the surface of a metallic structure despite not containing hazardous substances, chromium and fluorine.

BACKGROUND ART

For the purpose of improving the corrosion resistance and the coating adhesion of a metallic base material, chemical conversion treatment for forming a chemical conversion film on the surface of a metallic base material by means of a chemical reaction between the material and a chemical conversion treatment solution has been conducted from long ago. The most common chemical conversion treatment to be mentioned first is phosphate conversion treatment based on an acidic aqueous solution of phosphate. A conventional phosphate conversion treatment of a steel material is as follows.

If an acidic conversion treatment solution and a steel material are brought into contact with each other, the steel surface is etched (phenomenon of corrosion). Acid is spent during the etching, so that the pH rises at the solid-liquid interface, and insoluble phosphate is deposited on the steel surface. If zinc, manganese or the like is made coexistent in the conversion treatment solution, zinc phosphate, manganese phosphate, or other crystalline salt is deposited. Deposit films of such phosphates are suitable for a base for coating, and have excellent effects of improving the coating adhesion, suppressing under-film corrosion to greatly enhance the corrosion resistance, and so forth.

Phosphate conversion treatment was put to practical use nearly a hundred years ago, and a variety of improvements have been proposed until today. During phosphate conversion treatment, however, iron dissolves out as a by-product due to the etching of a steel material. The iron is converted in the system into iron phosphate, which is precipitated and periodically discharged from the system. At present, the precipitates (in sludge form) are disposed as industrial wastes, or reused as components of a material for tiles and the like. In recent years, reduction in industrial wastes in themselves is required for a more potent protection of the global environment, and it is earnestly desired to fulfill such requirement by developing a chemical conversion treatment solution or chemical conversion method generating no wastes. In addition, a combined use of a fluoride complex and hydrofluoric acid is necessary for a uniform etching in phosphate conversion treatment, which makes it indispensable to conduct effluent treatment with respect to fluoric components.

Another typical treatment is chromate conversion treatment. Chromate conversion treatment also has a long history of its practical use, and is finding wide application even today in surface treatment of a metallic material, such as an aircraft material, a building material, and a material for automotive parts. The conversion treatment solution to be used for chromate conversion is based on chromic acid comprising hexavalent chromium, and allows a chemical conversion film partially containing the hexavalent chromium to be formed on the metallic material surface. While the chemical conversion film as formed by chromate conversion treatment is excellent in corrosion resistance and coating adhesion, the treatment inevitably requires large-scale effluent treatment equipment because the conversion treatment solution contains hazardous hexavalent chromium, and hazardous fluoric components as well.

[Recently, surface treatment with a chemical conversion treatment solution containing a zirconium compound (hereafter also referred to as "zirconium-based conversion treatment solution") is attracting attention as the chemical conversion treatment for the metallic material surface that is to be employed instead of phosphate conversion treatment or chromate conversion treatment, and is adapted to reduce environmental impacts. As an example, the following methods are proposed in patent literatures.

Patent Literature 1 proposes a chemical conversion coating agent composed of at least one selected from the group consisting of zirconium, titanium and hafnium, fluorine, and a water-soluble resin.

Patent Literature 2 proposes a chemical conversion coating agent composed of at least one selected from the group consisting of zirconium, titanium and hafnium, fluorine, and at least one selected from the group consisting of an amino group-containing silane coupling agent, a hydrolysate thereof and a polymer thereof.

Patent Literature 3 proposes a chemical conversion coating agent composed of at least one selected from the group consisting of zirconium, titanium and hafnium, fluorine, and an agent for imparting adhesiveness and corrosion resistance.

Each of the zirconium-based conversion treatment solutions as above does not contain chromium, that is to say, has less impact on the environment, and is capable of improving the metallic material surface in corrosion resistance and coating adhesion. The chemical conversion treatment solutions of Patent Literatures 1 through 3, however, contain fluorine, a toxic substance designated, as an essential component. As a recent tendency, ordinances regulating the fluorine content of waste water more severely by defining its permissible values much smaller are put into effect. Since compliance with such ordinances is hardly possible from the viewpoint of not only technology but capital investment, it is a matter of importance and urgency to attain a chemical conversion treatment solution containing no fluorine.

Taking the above problems into account, the technologies as proposed by Patent Literatures 1 through 3 are still far from satisfactory in terms of the reduction in environmental impact.

Patent Literature 4 proposes a chromium-free composition for metal surface treatment, whereupon the chemical conversion film as formed with the proposed composition on the metallic material surface contains a plurality of metallic elements, with at least one metallic element having two or more valences. In the literature, metallic elements Mg, Al, Ti, V, Mn, Fe, Co, Ni, Cu, Zn, Sr, Nb, Y, Zr, Mo, In, Sn, Ta and W, as well as oxoates, sulfates, nitrates, carbonates, silicates, acetates and oxalates thereof are described, although neither halides nor halogen-containing compounds are mentioned. Therefore, the proposed surface treatment composition can be considered as fluorine-free. The surface treatment composition, however, is disadvantageous in that it is less stable, does not allow an adequate deposition of metal, and brings about a chemical conversion film with a nonuniform thickness on the metal surface.

Patent Literature 5 proposes the protective film forming method in which a metal protective film obtained from a liquid composition containing (A) at least one selected from among Ti, V, Mn, Y, Zr, Nb, Mo, Tc, Ru, Rh, Pd and W, (B) at least one selected from among organic acids and/or inorganic acids and/or salts thereof, and (C) fluorine as an optional component is dried without rinsing. The liquid composition contains neither hazardous hexavalent chromium nor a hazardous fluorine compound as an essential component. The protective film forming method as proposed, however, is not appropriate to the surface treatment as base for coating because the metal protective film as dried without rinsing lacks denseness and uniformity and, accordingly, has a poor coating adhesion.

Patent Literature 6 proposes the metal surface treatment method in which a metal surface treatment composition containing zirconium ions and/or titanium ions, an adhesion imparting agent and a stabilizer is used to form a rust preventive film with a high throwing power on a metallic base having a plurality of curved parts before cationic electrodeposition coating. The adhesion imparting agent is (A) a silicon-containing compound, (B) an adhesion imparting ion, or (C) an adhesion imparting resin. The stabilizer is used to prevent components in the rust preventive film from dissolving out during the electrodeposition coating, and is hydroxy acid, amino acid, aminocarboxylic acid, aromatic acid, a phosphonate compound, a sulfonate compound, or a multivalent anion. Fluorine is not an essential component of the surface treatment composition, so that a surface treatment composition containing no fluorine is not focusing attention in itself on its stability. In fact, it was found by the check experiments of Examples 1 and 7 containing no fluorine that iron is stabilized in line with the description, while zirconium cannot be stabilized, leading to precipitates. In other words, it was not possible to form a rust preventive film based on zirconium. The proposed method is thus inappropriate to industrialization.

Patent Literature 7 proposes the metal surface treatment liquid for cationic electrodeposition coating which contains zirconium ions, copper ions and other metal ions, and having a pH of 1.5 to 6.5. The other metal ions are tin ions, indium ions, aluminum ions, niobium ions, tantalum ions, yttrium ions, or cerium ions. The zirconium ion concentration is 10 to 10,000 ppm, the concentration ratio of the copper ions to the zirconium ions is 0.005 to 1 on a weight basis, and the concentration ratio of the other metal ions to the copper ions is 0.1 to 1000 on a weight basis. While fluorine is not an essential component, a fluoride is used in each Example.

Patent Literature 8 proposes the metal surface treatment solution for cationic electrodeposition coating which contains zirconium ions and tin ions, and having a pH of 1.5 to 6.5. The zirconium ion concentration is 10 to 10,000 ppm, and the concentration ratio of the tin ions to the zirconium ions is 0.005 to 1 on a weight basis. While fluorine is not an essential component, a fluoride is used in each Example.

If a zirconium-based conversion agent contains fluorine, a certain amount of fluorine is incorporated into a film of zirconium hydroxide or oxide deposited, which raises the problem of decrease in coating adhesion. Patent Literature 9 proposes a method for setting the fluorine concentration of a chemical conversion film to 10% or less on the atom ratio basis. It is described in the literature that, in order to set the fluorine concentration of the chemical conversion film to 10% or less on the atom ratio basis, a chemical conversion coating agent is caused to contain magnesium, calcium, zinc, a silicon-containing compound, and copper, or the chemical conversion film is heated and dried at a temperature of 30° C. or more, or the chemical conversion film is treated with a basic aqueous solution having a pH of 9 or more to thereby remove soluble fluorine from the film. It, however, is not possible to entirely remove fluoric components adversely affecting the environment and the human body from the chemical conversion film.

CITATION LIST

Patent Literature

Patent Literature 1: JP 2004-218074 A
Patent Literature 2: JP 2008-184690 A
Patent Literature 3: JP 2008-184620 A
Patent Literature 4: JP 2001-247977 A
Patent Literature 5: JP 2003-171778 A
Patent Literature 6: JP 2008-088551 A
Patent Literature 7: JP 2008-174832 A
Patent Literature 8: JP 2008-291345 A
Patent Literature 9: JP 2004-218072 A

SUMMARY OF INVENTION

Technical Problems

An object of the present invention is to solve the above problems with the prior art by providing a chemical conversion treatment solution for metal surfaces, wherein the treatment solution contains neither chromium nor fluorine, both adversely affecting the environment and the human body, and at the same time particularly suitable for industrialization. In other words, the present invention has an object of providing a chemical conversion treatment solution for metal surfaces allowing formation of a chemical conversion film with a high corrosion resistance and a good coating adhesion on the surface of a metallic base material. It is an object of the present invention to provide a chemical conversion treatment solution for metal surfaces that can be produced without any particular effluent treatment equipment, and allows surface treatment of a metallic structure without any particular effluent treatment equipment, naturally because of containing neither chromium nor fluorine. Another object of the present invention is to provide a method for subjecting the surface of a structure made of a ferrous or nonferrous metallic base material to surface treatment with such a chemical conversion treatment solution for metal surfaces as above, and coating the chemical conversion film thus formed on the structure.

Solution to Problems

The above objects are achieved by the present invention as described in the following (1) through (16).

(1) A chromium- and fluorine-free chemical conversion treatment solution for metal surfaces comprising:

- at least one compound (A) selected from the group consisting of water-soluble titanium compounds and water-soluble zirconium compounds, and
- at least one organic compound (B), as a stabilizer, with two to three functional groups in one molecule, wherein said compound (A) content is 0.1 to 10 mmol/L, said organic compound (B) content is 2.5 to 10 times as high as a metal content of said compound (A) by mole, and the pH of said chemical conversion treatment solution falls within the range of 2.0 to 6.5.

(2) The chemical conversion treatment solution for metal surfaces according to (1) as described herein above, wherein said organic compound (B) is an organic compound having two to three functional groups in one molecule, with the functional groups being at least one species selected from the group consisting of a hydroxy group, a carboxyl group, an amino group and a phosphonic acid group.

(3) The chemical conversion treatment solution for metal surfaces according to (2) as described herein above, wherein said organic compound (B) is at least one organic compound selected from the group consisting of organic compounds having one carboxyl group and one hydroxy group in one molecule; an organic compound having one carboxyl group and one amino group in one molecule; an organic compound having one carboxyl group and two amino groups in one molecule; an organic compound having two carboxyl groups and one amino group in one molecule; an organic compound having two carboxyl groups and one hydroxy group in one molecule; an organic compound having two phosphonic acid groups and one hydroxy group in one molecule; and/or a salt thereof.

(4) The chemical conversion treatment solution for metal surfaces according to (2) as described herein above, wherein said organic compound (B) is an organic compound having two to three carboxyl groups in one molecule, an alcohol having two to three hydroxy groups in one molecule, and/or a salt thereof.

(5) The chemical conversion treatment solution for metal surfaces according to (3) as described herein above, wherein said organic compound having one carboxyl group and one hydroxy group in one molecule is glycolic acid, lactic acid or salicylic acid, said organic compound having one carboxyl group and one amino group in one molecule is glycine or alanine, said organic compound having one carboxyl group and two amino groups in one molecule is asparagine, said organic compound having two carboxyl groups and one amino group in one molecule is aspartic acid or glutamic acid, said organic compound having two carboxyl groups and one hydroxy group in one molecule is malic acid, and said organic compound having two phosphonic acid groups and one hydroxy group in one molecule is 1-hydroxyethylidene-1,1-diphosphonic acid.

(6) The chemical conversion treatment solution for metal surfaces according to (4) as described herein above, wherein said organic compound having two to three carboxyl groups in one molecule is oxalic acid, and said alcohol having two to three hydroxy groups in one molecule is glycerin.

(7) The chemical conversion treatment solution for metal surfaces according to any one of (1) through (6) as described herein above, wherein said water-soluble titanium compound is at least one selected from the group consisting of titanium sulfate, titanium oxysulfate, titanium ammonium sulfate, titanium nitrate, titanium oxynitrate and titanium ammonium nitrate.

(8) The chemical conversion treatment solution for metal surfaces according to any one of (1) through (6) as described herein above, wherein said water-soluble zirconium compound is at least one selected from the group consisting of zirconium sulfate, zirconium oxysulfate, zirconium ammonium sulfate, zirconium nitrate, zirconium oxynitrate, zirconium ammonium nitrate, zirconium acetate, zirconium lactate, zirconium chloride and zirconium ammonium carbonate.

(9) The chemical conversion treatment solution for metal surfaces according to any one of (1) through (8) as described herein above, further comprising metal ions (C) of at least one metal selected from the group consisting of aluminum, zinc, magnesium, calcium, copper, tin, iron, nickel, cobalt, manganese, indium, yttrium, tellurium, cerium and lanthanum.

(10) The chemical conversion treatment solution for metal surfaces according to any one of (1) through (9) as described herein above, further comprising at least one silicon compound (D) selected from the group consisting of silane coupling agents and colloidal silicas, in an amount of 0.02 to 20 mmol/L.

(11) The chemical conversion treatment solution for metal surfaces according to any one of (1) through (10) as described herein above, further comprising at least one cationic water-soluble resin (E) selected from the group consisting of water-soluble oligomers containing amino groups and water-soluble polymers containing amino groups, in an amount of 0.001 to 1 mmol/L.

(12) The chemical conversion treatment solution for metal surfaces according to any one of (1) through (11) as described herein above, further comprising one or more nonionic surfactants.

(13) A metal surface treatment method comprising a step of: using the chemical conversion treatment solution for metal surfaces according to any one of (1) through (12) as described herein above to conduct surface treatment on a surface of a structure constructed of at least one metal plate selected from the group consisting of cold-rolled steel plates; aluminum plates and aluminum alloy plates; zinc plates and zinc alloy plates; and galvanized steel plates and alloyed galvanized steel plates, to thereby form a chemical conversion film on the surface.

(14) A metal surface treatment method comprising a step of: using the chemical conversion treatment solution for metal surfaces according to any one of (1) through (12) as described herein above to conduct electrolysis on a surface of a structure constructed of at least one metal plate selected from the group consisting of cold-rolled steel plates; aluminum plates and aluminum alloy plate; zinc plates and zinc alloy plates; and galvanized steel plates and alloyed galvanized steel plates, with the metal plate serving as a cathode, to thereby form a chemical conversion film on the surface.

(15) A metal surface treatment method comprising a step of: bringing the chemical conversion treatment solution for metal surfaces according to (12) as described herein above into contact with a metallic material so as to carry out degreasing and chemical conversion of the metallic material at a time.

(16) A metal surface coating method comprising a step of: conducting at least one coating process selected from the group consisting of electrodeposition, powder coating and solvent coating on a chemical conversion film of a structure as treated by the metal surface treatment method according to any one of (13) through (15) as described herein above.

Advantageous Effects of Invention

The chemical conversion treatment solution for metal surfaces of the present invention contains neither chromium nor fluorine, both hazardous to the environment and the human body, and at the same time imparts a high corrosion resistance and a good coating adhesion to the surface of a metallic structure by forming a chemical conversion film containing an oxide or hydroxide of titanium and/or zirconium on the metallic structure surface. A complete elimination of chromium and fluorine from a chemical conversion treatment solution makes it possible to provide a chemical conversion treatment solution and a metal surface treatment method requiring no particular effluent treatment with respect to chromium and fluorine during production of the chemical conversion treatment solution and during the surface treatment of a metallic material or metallic structure with a chemical conversion treatment solution, respectively.

DESCRIPTION OF EMBODIMENTS

The present inventors noticed effective functions of the fluorine in a chemical conversion treatment solution containing a water-soluble titanium compound and/or a water-soluble zirconium compound (hereafter also referred to simply as "titanium-based compound/zirconium-based compound") (the treatment solution being hereafter also referred to simply as "chemical conversion treatment solution"), that is to say, confirmed that fluorine is the essential component of a chemical conversion treatment solution that plays an important role in stabilizing a titanium-based compound/zirconium-based compound in the treatment solution, and etching the metallic base material surface. It was found in particular that fluorine stabilizes a titanium-based compound/zirconium-based compound in an acid region of a chemical conversion treatment solution, and is readily dissociated by the pH increase involving the etching of the metallic base material surface, so that fluorine is effective at forming a chemical conversion film.

When, however, the present inventors examined various compounds in order to further stabilize a titanium-based compound/zirconium-based compound in a chemical conversion treatment solution, they found the following: In the chemical conversion treatment solution which contains fluorine, a certain compound (hereafter also referred to simply as "organic compound (B)") also contained in the treatment solution in an amount not exceeding a specified amount is effective at stabilizing a titanium-based compound/zirconium-based compound, and does not suppress the deposition of titanium and/or zirconium, although a certain amount of fluorine is contained in the chemical conversion film of titanium and/or zirconium as deposited. If the amount of organic compound (B) is larger than the specified one, the stability between a titanium-based compound/zirconium-based compound and organic compound (B) is made higher at the metallic base material interface due to the pH increase at the interface that involves the etching of the metallic base material surface, so that titanium and/or zirconium is not able to be deposited or precipitated on the metallic base material surface as an oxide or hydroxide to thereby form a chemical conversion film.

On the other hand, a chemical conversion treatment solution containing no fluorine proved unique in that titanium and/or zirconium is deposited as an oxide or hydroxide to form a chemical conversion film even if a large amount of organic compound (B) is present in the treatment solution. In other words, the present inventors found that the chemical conversion treatment solution which is chromium-free and fluorine-free, and whose organic compound (B) content is so controlled as to fall within a specified range will allow a chemical conversion film equivalent in corrosion resistance and coating adhesion to that provided using a fluorine-containing chemical conversion treatment solution, and thus completed the present invention.

It should be noted that the term "chromium-free" means containing no metallic chromium, no chromium ions and no chromium compounds, while the term "fluorine-free" means containing no fluorine atoms, no fluorine ions and no fluorine-containing compounds.

Water-soluble titanium compound and water-soluble zirconium compound (A) of the present invention are essential components significantly responsible for the corrosion resistance, with examples including titanium sulfate, titanium oxysulfate, titanium ammonium sulfate, titanium nitrate, titanium oxynitrate, titanium ammonium nitrate, zirconium sulfate, zirconium oxysulfate, zirconium ammonium sulfate, zirconium nitrate, zirconium oxynitrate, zirconium ammonium nitrate, zirconium acetate, zirconium lactate, zirconium chloride, and zirconium ammonium carbonate. The titanium or zirconium content or the total content of titanium and zirconium is preferably 0.1 to 10 mmol/L, and more preferably 0.5 to 5 mmol/L. With a content of less than 0.1 mmol/L, titanium or zirconium is not adhered to a metallic base material adequately, which makes the corrosion resistance poorer. With a content of more than 10 mmol/L, titanium or zirconium is deposited in larger amounts, which may reduce the adhesion to a coating subsequently applied.

Organic compound (B) of the present invention, as being a component effective at stabilizing a titanium-based compound/zirconium-based compound in a chemical conversion treatment solution, is a compound having two to three functional groups in one molecule, with the functional groups comprising hydroxy groups, carboxyl groups, amino groups or phosphonic acid groups. If organic compound (B) has not more than one functional group, titanium and/or zirconium in a chemical conversion treatment solution cannot be stabilized adequately in the treatment solution. A compound with four or more functional groups is too potent in stabilization in a chemical conversion treatment solution, so that dissociation by the pH increase does not occur, and a chemical conversion film is hard to deposit. Organic compound (B) is any of monocarboxylic acid derivatives, dicarboxylic acid derivatives, tricarboxylic acid derivatives, monool derivatives, diol derivatives, triol derivatives, amino acid derivatives, phosphonic acid derivatives, and the like as well as salts thereof. A preferred compound has different functional groups.

To be more specific: Preferred are a compound having one carboxyl group and one hydroxy group, such as glycolic acid, lactic acid and salicylic acid; a compound having one carboxyl group and one amino group, such as glycine and alanine; a compound having one carboxyl group and two amino groups, such as asparagine; a compound having one carboxyl group, one hydroxy group and two amino groups, such as aspartic acid and glutamic acid; a compound having two carboxyl groups and one hydroxy group, such as malic acid; a compound having two phosphonyl groups and one hydroxy group, such as 1-hydroxyethylidene-1,1-diphosphonic acid; a compound having two carboxyl groups, such as oxalic acid; a trihydric alcohol such as glycerin; and salts thereof. Particularly preferred compounds include glycolic acid, lactic acid, asparagine, oxalic acid, and 1-hydroxyethylidene-1,1-diphosphonic acid.

The organic compound (B) content is 2.5 to 10 times, preferably 3 to 8 times, as high as the content of metallic titanium and/or metallic zirconium in the titanium compound and/or zirconium compound by mole. If the organic compound (B) content is less than 2.5 times higher by mole, titanium and/or zirconium in the chemical conversion treatment solution cannot be stabilized adequately. A content more than 10 times higher by mole makes the compound too potent in stabilization, so that dissociation by the pH increase does not occur, and a chemical conversion film is hard to deposit.

The corrosion resistance may further be improved by adding metal ions (C) to the chemical conversion treatment solution of the present invention and co-depositing them as metal. Metal ions (C) used may be ions of at least one selected from among aluminum, zinc, magnesium, calcium, copper, tin, iron, nickel, cobalt, manganese, indium, and tellurium. Metal ions (C) are preferably 2 to 5000 ppm by weight, more preferably 10 to 2000 ppm by weight, in amount. With an amount less than 2 ppm by weight, the added metal ions cannot be codeposited, and expected effects fail to follow. An amount more than 5000 ppm by weight is unfavorable because the stability of the chemical conversion treatment solution in itself may be impaired.

The coating adhesion may further be improved by adding silicon compound (D) to the chemical conversion treatment solution of the present invention and co-depositing the compound. A silicon compound is suitably added if the adhesion between a coating applied and a chemical conversion film is not so good as expected. Examples of silicon compound (D) include silane coupling agents and colloidal silicas, with amino group-containing aminosilane coupling agents, epoxy group-containing epoxysilane coupling agents, and colloidal silicas being preferred. Several silicon compounds (D) may also be used in combination. The silicon compound (D) content is preferably 0.02 to 20 mmol/L. With a lower content, silicon compound (D) cannot be considered as effective at improving the coating adhesion, that is to say, the compound is added in vain. Silicon compound (D) at a higher content is unfavorable because it may prevent the chemical conversion reaction.

The chemical conversion treatment solution of the present invention may further contain cationic water-soluble resin (E). Cationic water-soluble resin (E), as being simultaneously deposited and adhered onto a metallic base material, has an effect of improving the coating adhesion and the corrosion resistance, and is particularly suitable for use if, for instance, the adhesion between a coating applied and a chemical conversion film or the corrosion resistance is not so excellent as expected. Preferably, at least one selected from among amino group-containing water-soluble oligomers and polymers is used as cationic water-soluble resin (E). Typical examples of usable resins include polyvinyl alcohols, polyvinyl phenols, and phenol-formalin condensates. In terms of the molecular weight, those resins having a molecular weight of 2000 to 10,000 falling within an oligomeric range and having a molecular weight of 10,000 to 30,000 falling within a polymeric range are usable. Oligomer-type resins with a lower molecular weight are preferable in order not to prevent the chemical conversion reaction. The resin (E) content is 0.001 to 1 mmol/L. The range of this content depends on the molecular weight, and the resin (E) content as expressed more specifically on the basis of percentage (parts per million) by weight is preferably 20 to 12,000 ppm, and more preferably 40 to 400 ppm. With a lower content, cationic water-soluble resin (E) cannot be considered as effective at improving the coating adhesion, that is to say, the resin is added in vain. Cationic water-soluble resin (E) at a higher content is unfavorable because it may prevent the deposition of titanium or zirconium, causing a decrease rather than increase in corrosion resistance.

The chemical conversion treatment solution of the present invention may further contain at least one nonionic surfactant. Any conventional nonionic surfactant is available. If the chemical conversion treatment solution of the present invention contains a surfactant, a desirable film will be formed even on a metallic material not treated in advance to degrease and clean it. In other words, the inventive conversion treatment solution which contains a surfactant is applicable as a surface treatment agent for use in both degreasing and chemical conversion.

No particular limitations are put on the method of preparing the chemical conversion treatment solution of the present invention, in which the essential components, namely components (A) and (B) as above, and the optional components, components (C)-(D) as above, are added to an aqueous solvent in any order. In a preferred method of preparation, for instance, the essential components are added to an aqueous solvent, then may be followed by the optional components, and the resultant mixture is agitated at a normal temperature, heated, and adjusted in pH.

The pH is critical for the chemical conversion treatment solution of the present invention, that is to say, the inventive conversion treatment solution should be controlled so that its pH may fall within the range of 2.0 to 6.5. A pH less than 2.0 is unfavorable because a metallic base material is dissolved in larger amounts to increase sludge. On the other hand, the chemical conversion treatment solution with a pH of more than 6.5 is unfavorable because it is less capable of removing an oxide film from the metallic base material surface, and may cause reduction in corrosion resistance or coating adhesion. A more preferred pH range is from 2.5 to 6.0. The pH may be adjusted in any way by the addition of an acid, such as nitric acid, sulfuric acid, hydrochloric acid and acetic acid, or an alkali, such as potassium hydroxide, sodium hydroxide, calcium hydroxide, alkaline metal salts, aqueous ammonia, ammonium hydrogencarbonate and amines.

The metal surface treatment method of the present invention is implemented by bringing the chemical conversion treatment solution as described above into contact with a metallic base material or a metallic structure. The surface of the metallic base material or metallic structure with which the conversion treatment solution is to be brought into contact needs to be clean. Oil, soil, metal powder (occurring due to abrasion or upon forming), and so forth should be removed. Cleaning may be carried out in any way, and industrially common cleaning methods including alkali cleaning are available. The metallic base material or metallic structure as cleaned is washed with water to rinse alkaline components and so forth out of the surface thereof, and then the chemical conversion treatment solution of the present invention is brought into contact with the surface. As described before, a desirable film will be formed even on a metallic material not treated in advance to degrease and clean it if the chemical conversion treatment solution of the present invention contains a surfactant. That is to say, in such a case, degreasing treatment and chemical conversion treatment for forming a film are conducted on a metallic material at a time in the step of bringing the conversion treatment solution into contact with the metallic material. The chemical conversion reaction is preferably carried out at a temperature of 30 to 60° C. While dependent on the properties of the metallic base material or a base material for the metallic structure, the concentration of the chemical conversion treatment solution, and the chemical conversion temperature, the time for the chemical conversion reaction is generally 2 to 600 seconds. A complicated structure, typically an automotive body, is usually kept in contact with the chemical conversion treatment solution by immersion for 30 to 120 seconds taking account of a necessary replacement of the conversion treatment solution within a closed structure. In that case, chemical conversion may also be carried out by spraying as long as the replacement of the chemical conversion treatment solution is possible.

The metal surface treatment method of the present invention may be implemented by conducting electrolysis in the chemical conversion treatment solution, with a metallic base material or a metallic structure being used as a cathode. During the electrolysis using a metallic base material or a metallic structure as a cathode, hydrogen reduction reaction occurs at the cathode interface, leading to an increase in pH. Along with the pH increase, the stability of a titanium compound and/or a zirconium compound is reduced at the cathode interface, and a chemical conversion film as an oxide or hydroxide is deposited.

During metal surface treatment, metal ions dissolve out of a metallic base material, although no problem is raised by the fact that the chemical conversion treatment solution contains such metal ions. Even though iron ions in the chemical conversion treatment solution are gradually increased during the surface treatment of a cold-rolled steel plate, for instance, problems with sludge and the like are not caused as long as the chemical conversion treatment solution is so controlled as to have an iron ion content falling within the range as mentioned before. Nevertheless, it is preferable to actively remove such dissolving-out components from the system with a centrifuge, by filtration through various membranes, and so forth.

According to the metal surface treatment method of the present invention, it is preferable that titanium and/or zirconium, both significantly responsible for the corrosion resistance, is deposited on a metallic base material or a metallic structure in an amount of 0.02 to 2 mmol/$m^2$ in total. A deposit amount of less than 0.02 mmol/$m^2$ is too small to give a satisfactory corrosion resistance. Deposition in an amount of more than 2 mmol/$m^2$ still results in an acceptable corrosion resistance, but may reduce the coating adhesion and, accordingly, is unfavorable. A more preferred range is from 0.1 mmol/$m^2$ to 1.5 mmol/$m^2$. In terms of the film thickness, the deposit amount is defined to be 2 to 200 nm, with a more preferred range being from 20 nm to 100 nm. It should be noted that the chemical conversion film is considered to be composed basically of an oxide or hydroxide of titanium and/or zirconium.

The metallic base material to which the metal surface treatment method of the present invention is to be applied is not necessarily limited, while a practically used material, such as a cold-rolled steel plate, a hot-rolled pickled steel plate, an aluminum plate, an aluminum alloy plate, a zinc plate, a zinc alloy plate, a galvanized steel plate, or an alloyed galvanized steel plate, may be mentioned as an example. Usable galvanized steel plates are not necessarily limited, with examples including hot-dip galvanized ones, electrogalvanized ones, and vapor galvanized ones.

To a metallic base material or metallic structure having a chemical conversion film formed thereon by the metal surface treatment method of the present invention, a coating material may be applied by electrodeposition, powder coating, solvent coating or the like. Conventional coating materials and processes are available for the application. For instance, electrodeposition may be conducted using a cationic electrodeposition paint containing an amine-added epoxy resin and a blocked polyisocyanate curing agent, powder coating may be conducted using a polyester paint, epoxy paint, epoxy/polyester paint or acrylic paint, or solvent coating may be conducted using such a paint as based on an epoxy modified resin, a melamine alkyd resin or an acrylic resin.

EXAMPLES

In the following, the chemical conversion treatment solution and the metal surface treatment method according to the present invention are illustrated by means of Examples and Comparative Examples, to which the present invention is in no way limited.

The metallic base materials as used, the pretreatment and surface treatment as conducted on the metallic base materials, the coating processes, and the methods of evaluating the metallic base materials provided with chemical conversion films (on the deposit amount of component (A), the coating adhesion, the corrosion resistance, and the sludge generation) are as described below. The compositions of the individual chemical conversion treatment solutions are also set forth in Table 1. Evaluation test results for the metallic base materials are set forth in Tables 2 through 4.

Base Material

Three types of metallic base materials: cold-rolled steel plates each measuring 70×150×0.8 mm, SPCC (JIS G 3141); alloyed hot-dip galvanized steel plates each measuring 70×150×0.8 mm, SGCC F06 MO (JIS G 3302); and aluminum alloy plates each measuring 70×150×1.0 mm, A5052P (JIS A 4000), all manufactured by Paltec Test Panels Co., Ltd., were used. A cold-rolled steel plate, an alloyed hot-dip galvanized steel plate, and an aluminum alloy plate are hereafter abbreviated as SPC, GA, and AL, respectively.

Cleaning (Pretreatment)

The surface of each metallic base material had a rust preventive oil applied thereto, so that degreasing was performed by heating a degreasing agent "FINECLEANER" E2001 (component A, 13 g/L; component B, 7 g/L) manufactured by Nihon Parkerizing Co., Ltd. to 40° C., and spraying the metallic base materials with the heated degreasing agent for 120 seconds. The materials thus degreased were sprayed with water for rinsing for 30 seconds before chemical conversion films were formed on them in Examples and Comparative Examples.

Surface Treatment

Unless otherwise specified in any Example or Comparative Example, surface treatment was conducted under any one of the following sets of surface treatment conditions.

(1) Treatment temperature, 45° C.; treatment time, 90 seconds; treatment method, by dipping.

(2) The treatment temperature, 35° C.; the treatment time, 120 seconds; the treatment method, by dipping.

(3) The treatment temperature, 50° C.; the treatment time, 45 seconds; the treatment method, by dipping.

Application of Coating

Electrodeposition

Using an electrodeposition paint (GT-10HT manufactured by Kansai Paint Co., Ltd.), potentiostatic cathodic electrolysis was conducted for 180 seconds to deposit the paint on the metallic base material surface provided with a chemical conversion film. Subsequently, washing with water and baking by the heating at 170° C. for 20 minutes were performed so as to form a coating. The thickness of the coating was adjusted to 20 μm by controlling voltages.

(2) Powder Coating

A paint for use in powder coating ("Evaclad" (polyester-based) manufactured by Kansai Paint Co., Ltd.) was sprayed onto the metallic base material surface provided with a chemical conversion film under such conditions that the discharge rate was 180 g/min and the conveyer speed was 1.0 m/min, so as to form a 60-μm-thick coating on the surface, and the coating was baked at 180° C. for 20 minutes.

(3) Solvent Coating

Using a primer ("Metal King" BT manufactured by Yukosha Co., Ltd.) and a top coating paint ("Rakumin" 260 manufactured by Yukosha Co., Ltd.), spray coating was conducted on the metallic base material surface provided with a chemical conversion film. The undercoat thickness was adjusted to 20 μm, and the top coat thickness was adjusted to 25 μm.

Deposit Amount

The deposit amount of a chemical conversion film on the metallic base material as subjected to chemical conversion treatment was found as the deposit amount of component (A) which was quantified by an X-ray analyzer (ZSX "Primus II" manufactured by Rigaku Corporation). The material after chemical conversion treatment was rinsed with water, then with deionized water, and dried with cool air to obtain a sample for deposit amount measurement.

Coating Adhesion

Grids (with 100 pieces) were cut in the metallic base material to which a coating has been applied, and the material was immersed in boiling water for one hour. After water was wiped out, cellophane tape was attached to the material, and then removed by hand to count the number of the grids in which the coating did not peal off. It is considered that the number 100 indicates the best coating adhesion, while the number zero indicates the worst.

Corrosion Resistance

Crossed cuts were made in the metallic base material to which a coating has been applied, and a salt spray test (JIS Z 2371) was conducted on the material. After 480 hours, the maximum blister width on one side of the crossed cuts was evaluated. Generally speaking, in the case of cold-rolled steel plates, the maximum blister width is preferably not larger than 3 mm, and more preferably not larger than 2 mm. In the case of alloyed galvanized steel plates and aluminum alloy plates, the maximum blister width of alloyed galvanized steel plates and aluminum alloy plates is favorably not larger than 1.2 mm and 0.5 mm, respectively.

Sludge Generation

A test on sludge generation was conducted in order to evaluate the runnability upon industrialization. Each chemical conversion treatment solution was agitated at a specified temperature for one hour, then left standing before its appearance was observed in order to examine the stability of the pH and so forth of the treatment solution, and determine whether or not precipitates or the like were present (the observed appearance being referred to as "initial appearance"). Then metallic base materials having an area of 10 $m^2$ in total were successively subjected to surface treatment with the relevant chemical conversion treatment solution under specified treatment conditions. The treatment solution consumed (that is to say, whose concentrations were falling below the predetermined ones) along with the progress of chemical conversion due to the formation of a chemical conversion film were replenished appropriately so that their initial concentrations might be maintained. Subsequently to the surface treatment, the chemical conversion treatment solution was left standing at 40° C. for 48 hours before its appearance was observed to visually check the generation of precipitates (sludge) or the state (turbidity, etc.) of the treatment solution. It is preferable to observe no sludge.

Example 1

To water, components (A) and (B) as below were added in this order so that their concentrations might be as below. The resultant mixture was agitated at a normal temperature for 20 minutes, then heated to 45° C. and adjusted in pH to 4.0 with aqueous ammonia, so as to prepare chemical conversion treatment solution 1. The metallic base material as cleaned was subjected to surface treatment with chemical conversion treatment solution 1 under surface treatment condition 1 to form a chemical conversion film. The surface of the metallic base material thus treated was rinsed with water and then with deionized water without subsequent drying, and subjected to electrodeposition to form a coating.

(A): Zirconium sulfate, 0.5 mmol/L.

(B): Glycerin, 2.7 mmol/L.

(C), (D), (E): None.

Example 2

To water, components (A) and (B) as below were added in this order so that their concentrations might be as below. The resultant mixture was agitated at a normal temperature for 20 minutes, then heated to 50° C. and adjusted in pH to 3.0 with aqueous ammonia, so as to prepare chemical conversion treatment solution 2. The metallic base material as cleaned was subjected to surface treatment with chemical conversion treatment solution 2 under surface treatment condition 3 to form a chemical conversion film. The surface of the metallic base material thus treated was rinsed with water and then with deionized water without subsequent drying, and subjected to electrodeposition to form a coating.

(A): Titanium sulfate, 4.2 mmol/L.

(B): Glycine, 20.9 mmol/L.

(C), (D), (E): None.

Example 3

To water, components (A) through (C) as below were added in this order so that their concentrations might be as below. The resultant mixture was agitated at a normal temperature for 20 minutes, then heated to 35° C. and adjusted in pH to 3.5 with aqueous ammonia, so as to prepare chemical conversion treatment solution 3. The metallic base material as cleaned was subjected to surface treatment with chemical conversion treatment solution 3 under surface treatment condition 2 to form a chemical conversion film. The surface of the metallic base material thus treated was rinsed with water and then with deionized water without subsequent drying, and subjected to electrodeposition to form a coating.

(A): Zirconium nitrate, 1.1 mmol/L.

(B): Glycolic acid, 4.4 mmol/L.

(C): Aluminum nitrate, 5.6 mmol/L.

(D), (E): None.

Example 4

To water, components (A) through (C) as below were added in this order so that their concentrations might be as below. The resultant mixture was agitated at a normal temperature for 20 minutes, then heated to 45° C. and adjusted in pH to 3.0 with aqueous ammonia, so as to prepare chemical conversion treatment solution 4. The metallic base material as cleaned was subjected to surface treatment with chemical conversion treatment solution 4 under surface treatment condition 1 to form a chemical conversion film. The surface of the metallic base material thus treated was rinsed with water and then with deionized water without subsequent drying, and subjected to electrodeposition to form a coating.

(A): Titanium nitrate, 0.4 mmol/L.
(B): Lactic acid, 1.0 mmol/L.
(C): Aluminum nitrate, 5.6 mmol/L.
(D), (E): None.

Example 5

To water, components (A) through (C) and the surfactant as below were added in this order so that their concentrations might be as below. The resultant mixture was agitated at a normal temperature for 20 minutes, then heated to 35° C. and adjusted in pH to 3.0 with aqueous ammonia, so as to prepare chemical conversion treatment solution 5. The metallic base material as oiled and not degreased yet was subjected to surface treatment with chemical conversion treatment solution 5 under surface treatment condition 2 to form a chemical conversion film. The surface of the metallic base material thus treated was rinsed with water and then with deionized water without subsequent drying, and subjected to electrodeposition to form a coating.
(A): Zirconium acetate, 0.2 mmol/L.
(B): Oxalic acid, 1.3 mmol/L.
(C): Magnesium nitrate, 20.6 mmol/L.
(D), (E): None.
(Surfactant): Polyoxyethylene alkyl ether (the mean mole number of ethylene oxide added: 10 mol), 1 g/L.

Example 6

To water, components (A) through (D) as below were added in this order so that their concentrations might be as below. The resultant mixture was agitated at a normal temperature for 20 minutes, then heated to 45° C. and adjusted in pH to 3.0 with aqueous ammonia, so as to prepare chemical conversion treatment solution 6. The metallic base material as cleaned was subjected to surface treatment with chemical conversion treatment solution 6 under surface treatment condition 1 to form a chemical conversion film. The surface of the metallic base material thus treated was rinsed with water and then with deionized water, dried at 100° C. for 5 minutes, and subjected to electrodeposition to form a coating.
(A): Zirconium sulfate, 5.5 mmol/L.
(B): 1-hydroxyethylidene-1,1-diphosphonic acid (HEDP), 49.3 mmol/L.
(C): Magnesium nitrate, 20.6 mmol/L.
(D): Colloidal silica (the molecular weight: 60), 16 mmol/L.
(E): None.

Example 7

To water, components (A) through (E) as below were added in this order so that their concentrations might be as below. The resultant mixture was agitated at a normal temperature for 20 minutes, then heated to 35° C. and adjusted in pH to 3.5 with aqueous ammonia, so as to prepare chemical conversion treatment solution 7. In chemical conversion treatment solution 7, electrolysis was conducted at 5 A/dm$^2$ for 5 seconds using the cleaned metallic base material as a cathode and a carbon electrode as an anode, so as to form a chemical conversion film. The surface of the metallic base material thus treated was rinsed with water and then with deionized water without subsequent drying, and subjected to electrodeposition to form a coating.
(A): Titanium oxysulfate, 2.1 mmol/L.
(B): Aspartic acid, 12.5 mmol/L.
(C): Zinc nitrate, 10.4 mmol/L.
(D): None.
(E): Aminated polyvinyl phenol (the mean molecular weight: 10,000), 0.01 mmol/L.

Example 8

To water, components (A) through (E) as below were added in this order so that their concentrations might be as below. The resultant mixture was agitated at a normal temperature for 20 minutes, then heated to 45° C. and adjusted in pH to 4.0 with aqueous ammonia, so as to prepare chemical conversion treatment solution 8. The metallic base material as cleaned was subjected to surface treatment with chemical conversion treatment solution 8 under surface treatment condition 1 to form a chemical conversion film. The surface of the metallic base material thus treated was rinsed with water and then with deionized water, dried at 100° C. for 5 minutes, and subjected to electrodeposition to form a coating.
(A): Zirconium oxysulfate, 1.1 mmol/L.
(B): Glycolic acid, 5.5 mmol/L.
(C): Zinc nitrate, 10.4 mmol/L.
(D): Colloidal silica (the molecular weight: 60), 4 mmol/L.
(E): Aminated polyvinyl phenol (the mean molecular weight: 10,000), 0.01 mmol/L.

Example 9

To water, components (A) through (C) as below were added in this order so that their concentrations might be as below. The resultant mixture was agitated at a normal temperature for 20 minutes, then heated to 45° C. and adjusted in pH to 3.0 with aqueous ammonia, so as to prepare chemical conversion treatment solution 9. The metallic base material as cleaned was subjected to surface treatment with chemical conversion treatment solution 9 under surface treatment condition 1 to form a chemical conversion film. The surface of the metallic base material thus treated was rinsed with water and then with deionized water, dried at 100° C. for 5 minutes, and subjected to powder coating to form a coating.
(A): Titanium sulfate, 2.1 mmol/L.
(B): Asparagine, 10.4 mmol/L.
(C): Aluminum nitrate, 5.6 mmol/L.
(D), (E): None.

Example 10

To water, components (A) through (E) as below were added in this order so that their concentrations might be as below. The resultant mixture was agitated at a normal temperature for 20 minutes, then heated to 45° C. and adjusted in pH to 4.5 with aqueous ammonia, so as to prepare chemical conversion treatment solution 10. The metallic base material as cleaned was subjected to surface treatment with chemical conversion treatment solution 10 under surface treatment condition 1 to form a chemical conversion film. The surface of the metallic base material thus treated was rinsed with water and then with deionized water, dried at 100° C. for 5 minutes, and subjected to powder coating to form a coating.
(A): Zirconium oxysulfate, 1.1 mmol/L.
(B): Oxalic acid, 5.5 mmol/L.
(C): Zinc nitrate, 10.4 mmol/L.
(D): None.

(E): Aminated polyvinyl phenol (the mean molecular weight: 10,000), 0.01 mmol/L.

Example 11

To water, components (A) through (D) as below were added in this order so that their concentrations might be as below. The resultant mixture was agitated at a normal temperature for 20 minutes, then heated to 45° C. and adjusted in pH to 3.5 with aqueous ammonia, so as to prepare chemical conversion treatment solution 11. The metallic base material as cleaned was subjected to surface treatment with chemical conversion treatment solution 11 under surface treatment condition 1 to form a chemical conversion film. The surface of the metallic base material thus treated was rinsed with water and then with deionized water, dried at 100° C. for 5 minutes, and subjected to solvent coating to form a coating.

(A): Titanium nitrate, 10 mmol/L.
(B): Lactic acid, 50 mmol/L.
(C): Magnesium nitrate, 20.6 mmol/L.
(D): Aminopropyl triethoxysilane (the molecular weight: 264.5), 0.4 mmol/L.
(E): None.

Example 12

To water, components (A) through (C) as below were added in this order so that their concentrations might be as below. The resultant mixture was agitated at a normal temperature for 20 minutes, then heated to 45° C. and adjusted in pH to 3.0 with aqueous ammonia, so as to prepare chemical conversion treatment solution 12. The metallic base material as cleaned was subjected to surface treatment with chemical conversion treatment solution 12 under surface treatment condition 1 to form a chemical conversion film. The surface of the metallic base material thus treated was rinsed with water and then with deionized water, dried at 100° C. for 5 minutes, and subjected to solvent coating to form a coating.

(A): Zirconium sulfate, 0.5 mmol/L.
(B): Malic acid, 2.7 mmol/L.
(C): Zinc nitrate, 10.4 mmol/L.
(D), (E): None.

Comparative Example 1

To water, component (A) as below was added so that its concentration might be as below. The resultant mixture was agitated at a normal temperature for 20 minutes, then heated to 45° C. and adjusted in pH to 3.5 with aqueous ammonia, so as to prepare chemical conversion treatment solution 13. The metallic base material as cleaned was subjected to surface treatment with chemical conversion treatment solution 13 under surface treatment condition 1 to form a chemical conversion film. The surface of the metallic base material thus treated was rinsed with water and then with deionized water without subsequent drying, and subjected to electrodeposition to form a coating.

(A): Zirconium sulfate, 0.5 mmol/L.
(B): None.
(C), (D), (E): None.

Comparative Example 2

To water, components (A) and (B) as below were added so that their concentrations might be as below. The resultant mixture was agitated at a normal temperature for 20 minutes, then heated to 45° C. and adjusted in pH to 3.5 with aqueous ammonia, so as to prepare chemical conversion treatment solution 14. The metallic base material as cleaned was subjected to surface treatment with chemical conversion treatment solution 14 under surface treatment condition 1 to form a chemical conversion film. The surface of the metallic base material thus treated was rinsed with water and then with deionized water without subsequent drying, and subjected to electrodeposition to form a coating.

(A): Zirconium sulfate, 0.5 mmol/L.
(B): Formic acid, 2.7 mmol/L.
(C), (D), (E): None.

Comparative Example 3

To water, components (A) and (B) as below were added so that their concentrations might be as below. The resultant mixture was agitated at a normal temperature for 20 minutes, then heated to 45° C. and adjusted in pH to 3.5 with aqueous ammonia, so as to prepare chemical conversion treatment solution 15. The metallic base material as cleaned was subjected to surface treatment with chemical conversion treatment solution 15 under surface treatment condition 1 to form a chemical conversion film. The surface of the metallic base material thus treated was rinsed with water and then with deionized water without subsequent drying, and subjected to electrodeposition to form a coating.

(A): Zirconium sulfate, 0.5 mmol/L.
(B): Tartaric acid, 2.7 mmol/L.
(C), (D), (E): None.

Comparative Example 4

To water, components (A) and (B) as below were added so that their concentrations might be as below. The resultant mixture was agitated at a normal temperature for 20 minutes, then heated to 45° C. and adjusted in pH to 3.5 with aqueous ammonia, so as to prepare chemical conversion treatment solution 16. The metallic base material as cleaned was subjected to surface treatment with chemical conversion treatment solution 16 under surface treatment condition 1 to form a chemical conversion film. The surface of the metallic base material thus treated was rinsed with water and then with deionized water without subsequent drying, and subjected to electrodeposition to form a coating.

(A): Zirconium sulfate, 0.5 mmol/L.
(B): Lactic acid, 0.5 mmol/L.
(C), (D), (E): None.

Comparative Example 5

To water, components (A) and (B) as below were added so that their concentrations might be as below. The resultant mixture was agitated at a normal temperature for 20 minutes, then heated to 45° C. and adjusted in pH to 3.5 with aqueous ammonia, so as to prepare chemical conversion treatment solution 17. The metallic base material as cleaned was subjected to surface treatment with chemical conversion treatment solution 17 under surface treatment condition 1 to form a chemical conversion film. The surface of the metallic base material thus treated was rinsed with water and then with deionized water without subsequent drying, and subjected to electrodeposition to form a coating.

(A): Zirconium sulfate, 0.5 mmol/L.
(B): Lactic acid, 6.6 mmol/L.
(C), (D), (E): None.

Comparative Example 6

To water, components (A) and (B) as below were added so that their concentrations might be as below. The resultant mixture was agitated at a normal temperature for 20 minutes, then heated to 35° C. and adjusted in pH to 7.5 with aqueous ammonia, so as to prepare chemical conversion treatment solution 18. The metallic base material as cleaned was subjected to surface treatment with chemical conversion treatment solution 18 under surface treatment condition 2 to form a chemical conversion film. The surface of the metallic base material thus treated was rinsed with water and then with deionized water without subsequent drying, and subjected to electrodeposition to form a coating.

(A): Zirconium nitrate, 1.1 mmol/L.

(B): Glycolic acid, 8.8 mmol/L.

(C), (D), (E): None.

Comparative Example 7

Neodymium nitrate hexahydrate, a polyallylamine (the weight-average molecular weight: 1000), and aluminum sulfate were added to an aqueous solution of hexafluorozirconic acid, and the solution was then diluted with pure water to adjust its solute content to 500 ppm by weight for zirconium, 250 ppm by weight for neodymium, 30 ppm by weight for polyallylamine, and to 150 ppm by weight for aluminum. Subsequently, trace amounts of ammonium fluoride and sodium hydroxide were added to obtain chemical conversion treatment solution 19 at pH 3.6 containing 8 ppm by weight of free fluorine ions [as measured by a fluorine ion meter (model IM-55G manufactured by TOA Dempa Kogyo K.K.)]. Surface treatment was conducted by immersing the metallic base material as cleaned for 120 seconds in chemical conversion treatment solution 19 which had been heated to 40° C. (Corresponding to the invention as disclosed in JP 2007-327090 A, Example 1).

The metallic base material thus treated was rinsed with water and then with deionized water without subsequent drying, and subjected to electrodeposition to form a coating.

Comparative Example 8

Neodymium nitrate hexahydrate, a polyallylamine (the weight-average molecular weight: 1000), and aluminum sulfate were added to an aqueous solution of hexafluorozirconic acid, and the solution was then diluted with pure water to adjust its solute content to 500 ppm by weight for zirconium, 250 ppm by weight for neodymium, 30 ppm by weight for polyallylamine, and to 150 ppm by weight for aluminum. Subsequently, trace amounts of ammonium fluoride and sodium hydroxide were added to obtain chemical conversion treatment solution 20 at pH 3.6 containing 8 ppm by weight of free fluorine ions [as measured by a fluorine ion meter (model IM-55G manufactured by TOA Dempa Kogyo K.K.)]. Surface treatment was conducted by immersing the metallic base material as cleaned for 120 seconds in chemical conversion treatment solution 20 which had been heated to 40° C. (Corresponding to the invention as disclosed in JP 2007-327090 A, Example 1).

The metallic base material thus treated was rinsed with water and then with deionized water, dried (at 100° C. for 5 minutes), and subjected to powder coating to form a coating.

Comparative Example 9

Neodymium nitrate hexahydrate, a polyallylamine (the weight-average molecular weight: 1000), and aluminum sulfate were added to an aqueous solution of hexafluorozirconic acid, and the solution was then diluted with pure water to adjust its solute content to 500 ppm by weight for zirconium, 250 ppm by weight for neodymium, 30 ppm by weight for polyallylamine, and to 150 ppm by weight for aluminum. Subsequently, trace amounts of ammonium fluoride and sodium hydroxide were added to obtain chemical conversion treatment solution 21 at pH 3.6 containing 8 ppm by weight of free fluorine ions [as measured by a fluorine ion meter (model IM-55G manufactured by TOA Dempa Kogyo K.K.)]. Surface treatment was conducted by immersing the metallic base material as cleaned for 120 seconds in chemical conversion treatment solution 21 which had been heated to 40° C. (Corresponding to the invention as disclosed in JP 2007-327090 A, Example 1).

The metallic base material thus treated was rinsed with water and then with deionized water, dried (at 100° C. for 5 minutes), and subjected to the solvent coating as described before to form a coating.

Comparative Examples 10 Through 12

A 5% aqueous solution of a zinc phosphate conversion agent ("PALBOND" L3020 manufactured by Nihon Parkerizing Co., Ltd.) was used to conduct surface treatment under the conditions as below.

Surface conditioning: A surface conditioning agent ("PREPALENE" ZN manufactured by Nihon Parkerizing Co., Ltd.) was diluted with tap water to obtain a surface conditioning solution having a surface conditioning agent concentration of 0.1% by weight, and the metallic base material as cleaned was immersed in the solution at room temperature for 30 seconds so as to carry out surface control.

Zinc phosphate conversion treatment: A zinc phosphate conversion agent ("PALBOND" L3020 manufactured by Nihon Parkerizing Co., Ltd.) was diluted with tap water so that its concentration might be 5.0% by weight, and a sodium hydrogenfluoride reagent was added to the resultant solution so that the fluorine weight concentration might be 200 ppm by weight. Then, the total acidity and the free acidity were each adjusted so that the value thereof might fall in the center of the values according to the product catalog, so as to obtain a zinc phosphate conversion solution. The surface-controlled metallic base material was immersed in the conversion solution at 43° C. for 120 seconds to deposit a zinc phosphate conversion film.

Subsequently, electrodeposition, powder coating, and solvent coating were conducted in Comparative Examples 10, 11, and 12, respectively, to form a coating.

It is seen from Tables 2 through 4 that, in any of Examples 1 through 12, a chemical conversion film was formed on any type of metallic base material with an adequate deposit amount. It is also seen that the coating adhesion and the corrosion resistance were both excellent in any Example. The chemical conversion treatment solutions as used in Examples for surface treatment were clear and stable with no sludge even after being left standing at 40° C. for 48 hours.

In contrast, a chemical conversion treatment solution containing no stabilizers (Comparative Example 1), a chemical conversion treatment solution containing a stabilizer with a smaller number of functional groups (Comparative Example 2), and a chemical conversion treatment solution with a lower stabilizer content (Comparative Example 4) lacked stability and led to the generation of sludge. For this reason, the deposit amount of a chemical conversion film was inadequate, and the coating adhesion and the corrosion resistance were both poor. On the other hand, a chemical conversion treatment solution containing a stabilizer with a larger number of functional groups (Comparative Example 3), and a chemical conversion treatment solution with a higher stabilizer content (Comparative Example 5) were too stable to allow a chemical conversion film to be formed, so that the coating adhesion and the corrosion resistance were both poor. A chemical conversion treatment solution at a higher pH (Comparative Example 6) was less capable of removing an oxide film from the metallic base material surface, and caused reduction in coating adhesion and corrosion resistance.

TABLE 1

| | A | | B | | | C | | D | | E | | | Coating application method |
|---|---|---|---|---|---|---|---|---|---|---|---|---|---|
| | Species | mmol | Species | mmol | B/A | Species | mmol | Species | mmol | Species | mmol | pH | |
| Ex. 1 | Zr sulfate | 0.5 | Glycerin | 2.7 | 5.4 | — | — | — | — | — | — | 4 | Electrodeposition |
| Ex. 2 | Ti sulfate | 4.2 | Glycine | 20.9 | 5.0 | — | — | — | — | — | — | 3 | Electrodeposition |
| Ex. 3 | Zr nitrate | 1.1 | Glycolic acid | 4.4 | 4.0 | Al | 5.6 | — | — | — | — | 3.5 | Electrodeposition |
| Ex. 4 | Ti nitrate | 0.4 | Lactic acid | 1.0 | 2.5 | Al | 5.6 | — | — | — | — | 3 | Electrodeposition |
| Ex. 5 | Zr acetate | 0.2 | Oxalic acid | 1.3 | 6.5 | Mg | 20.6 | — | — | — | — | 3 | Electrodeposition |
| Ex. 6 | Zr sulfate | 5.5 | HEDP | 49.3 | 9.0 | Mg | 20.6 | Colloidal silica | 16 | — | — | 3 | Electrodeposition |
| Ex. 7 | Ti oxysulfate | 2.1 | Aspartic acid | 12.5 | 6.0 | Zn | 10.4 | — | — | Aminated polyvinyl phenol | 0.01 | 3.5 | Electrodeposition |
| Ex. 8 | Zr oxynitrate | 1.1 | Glycolic acid | 5.5 | 5.0 | Zn | 10.4 | Colloidal silica | 4 | Aminated polyvinyl phenol | 0.01 | 4 | Electrodeposition |
| Ex. 9 | Ti sulfate | 2.1 | Asparagin | 10.4 | 5.0 | Al | 5.6 | — | — | — | — | 3 | Powder coating |
| Ex. 10 | Zr oxynitrate | 1.1 | Oxalic acid | 5.5 | 5.0 | Zn | 10.4 | — | — | Aminated polyvinyl phenol | 0.01 | 4.5 | Powder coating |
| Ex. 11 | Ti nitrate | 10 | Lactic acid | 50 | 5.0 | Mg | 20.6 | Aminopropyl triethoxysilane | 0.4 | — | — | 3.5 | Solvent coating |
| Ex. 12 | Zr sulfate | 0.5 | Malic acid | 2.7 | 5.4 | Zn | 10.4 | — | — | — | — | 3 | Solvent coating |
| Comp. Ex. 1 | Zr sulfate | 0.5 | — | — | — | — | — | — | — | — | — | 3.5 | Electrodeposition |
| Comp. Ex. 2 | Zr sulfate | 0.5 | Formic acid | 2.7 | 5.4 | — | — | — | — | — | — | 3.5 | Electrodeposition |
| Comp. Ex. 3 | Zr sulfate | 0.5 | Tartaric acid | 2.7 | 5.4 | — | — | — | — | — | — | 3.5 | Electrodeposition |
| Comp. Ex. 4 | Zr sulfate | 0.5 | Lactic acid | 0.5 | 1.0 | — | — | — | — | — | — | 3.5 | Electrodeposition |
| Comp. Ex. 5 | Zr sulfate | 0.5 | Lactic acid | 6.6 | 13.2 | — | — | — | — | — | — | 3.5 | Electrodeposition |
| Comp. Ex. 6 | Zr nitrate | 1.1 | Glycolic acid | 8.8 | 8.0 | — | — | — | — | — | — | 7.5 | Electrodeposition |
| Comp. Ex. 7 | Fluorozirconic acid | 1.1 | — | | | Al | 5.6 | — | — | Polyallylamine | 0.03 | 3.6 | Electrodeposition |
| Comp. Ex. 8 | Fluorozirconic acid | 1.1 | — | | | Al | 5.6 | — | — | Polyallylamine | 0.03 | 3.6 | Powder coating |
| Comp. Ex. 9 | Fluorozirconic acid | 1.1 | — | | | Al | 5.6 | — | — | Polyallylamine | 0.03 | 3.6 | Solvent coating |
| Comp. Ex. 10 | Zn phosphate | — | — | | | — | — | — | — | — | — | | Electrodeposition |
| Comp. Ex. 11 | Zn phosphate | — | — | | | — | — | — | — | — | — | | Powder coating |
| Comp. Ex. 12 | Zn phosphate | — | — | | | — | — | — | — | — | — | | Solvent coating |

TABLE 2

| Evaluation test results (cold-rolled steel plates) SPC | | | | | |
|---|---|---|---|---|---|
| | Characteristics of | Coating performance | | Characterisics of chemical conversion solution | |
| | chemical conversion film Deposit amount of (A) mmol/m$^2$ | Coating adhesion Number of boxes | Corrosion resistance mm | Initial | Sludge generation 40° C., after 48 hrs. |
| Ex. 1 | 0.5 | 100 | 0.9 | Clear | Clear |
| Ex. 2 | 0.7 | 100 | 1.0 | Clear | Clear |
| Ex. 3 | 0.6 | 100 | 0.8 | Clear | Clear |
| Ex. 4 | 0.9 | 100 | 0.7 | Clear | Clear |
| Ex. 5 | 0.7 | 100 | 1.0 | Clear | Clear |

TABLE 2-continued

| Evaluation test results (cold-rolled steel plates) SPC | | | | | |
|---|---|---|---|---|---|
| | Characteristics of | Coating performance | | Characterisics of chemical conversion solution | |
| | chemical conversion film Deposit amount of (A) mmol/$m^2$ | Coating adhesion Number of boxes | Corrosion resistance mm | Initial | Sludge generation 40° C., after 48 hrs. |
| Ex. 6 | 0.6 | 100 | 0.8 | Clear | Clear |
| Ex. 7 | 0.8 | 100 | 0.9 | Clear | Clear |
| Ex. 8 | 0.4 | 100 | 1.0 | Clear | Clear |
| Ex. 9 | 1.3 | 100 | 1.4 | Clear | Clear |
| Ex. 10 | 0.6 | 100 | 0.8 | Clear | Clear |
| Ex. 11 | 1.2 | 100 | 1.1 | Clear | Clear |
| Ex. 12 | 0.7 | 100 | 0.9 | Clear | Clear |
| Comp. | 0.1 | 95 | 3.2 | White turbid | Sludge generated |
| Comp. | 0.1 | 93 | 3.5 | White turbid | Sludge generated |
| Comp. | 0.0 | 82 | 4.6 | Clear | Clear |
| Comp. | 0.1 | 95 | 3.4 | White turbid | Sludge generated |
| Comp. | 0.0 | 80 | 4.8 | Clear | Clear |
| Comp. | 0.4 | 50 | 4.2 | Clear | Clear |
| Comp. | 0.6 | 100 | 0.5 | Clear | Clear |
| Comp. | 0.6 | 100 | 1.6 | Clear | Clear |
| Comp. | 0.6 | 100 | 1.1 | Clear | Clear |
| Comp. | | 100 | 0.7 | Clear | Clear |
| Comp. | | 100 | 1.5 | Clear | Clear |
| Comp. | | 100 | 1.0 | Clear | Clear |

TABLE 3

| Evaluation test results (alloyed galvanized steel plates) GA | | | | | |
|---|---|---|---|---|---|
| | Characteristics of | Coating performance | | Characterisics of chemical conversion solution | |
| | chemical conversion film Deposit amount of (A) mmol/$m^2$ | Coating adhesion Number of boxes | Corrosion resistance mm | Initial | Sludge generation 40° C., after 48 hrs. |
| Ex. 1 | 0.4 | 100 | 0.8 | Clear | Clear |
| Ex. 2 | 0.6 | 100 | 0.9 | Clear | Clear |
| Ex. 3 | 0.5 | 100 | 0.6 | Clear | Clear |
| Ex. 4 | 0.7 | 100 | 0.9 | Clear | Clear |
| Ex. 5 | 0.6 | 100 | 0.7 | Clear | Clear |
| Ex. 6 | 0.5 | 100 | 0.9 | Clear | Clear |
| Ex. 7 | 0.5 | 100 | 1.0 | Clear | Clear |
| Ex. 8 | 0.4 | 100 | 0.7 | Clear | Clear |
| Ex. 9 | 1.0 | 100 | 1.1 | Clear | Clear |
| Ex. 10 | 0.5 | 100 | 0.9 | Clear | Clear |
| Ex. 11 | 0.9 | 100 | 1.0 | Clear | Clear |
| Ex. 12 | 0.6 | 100 | 0.8 | Clear | Clear |
| Comp. Ex. 1 | 0.1 | 95 | 1.7 | White turbid | Sludge generated |
| Comp. Ex. 2 | 0.1 | 90 | 1.8 | White turbid | Sludge generated |
| Comp. Ex. 3 | 0.0 | 88 | 1.8 | Clear | Clear |
| Comp. Ex. 4 | 0.1 | 95 | 1.6 | White turbid | Sludge generated |
| Comp. Ex. 5 | 0.0 | 88 | 1.9 | Clear | Clear |
| Comp. Ex. 6 | 0.2 | 55 | 1.8 | Clear | Clear |
| Comp. Ex. 7 | 0.5 | 100 | 0.6 | Clear | Clear |
| Comp. Ex. 8 | 0.5 | 100 | 1.2 | Clear | Clear |
| Comp. Ex. 9 | 0.5 | 100 | 1.4 | Clear | Clear |

TABLE 3-continued

| Evaluation test results (alloyed galvanized steel plates) GA | | | | | |
|---|---|---|---|---|---|
| | Characteristics of | Coating performance | | Characterisics of chemical conversion solution | |
| | chemical conversion film Deposit amount of (A) mmol/m$^2$ | Coating adhesion Number of boxes | Corrosion resistance mm | Initial | Sludge generation 40° C., after 48 hrs. |
| Comp. Ex. 1 | | 100 | 1.2 | Clear | Clear |
| Comp. Ex. 1 | | 100 | 1.1 | Clear | Clear |
| Comp. Ex. 1 | | 100 | 1.5 | Clear | Clear |

TABLE 4

| Evaluation test results (aluminum alloy plates) Al | | | | | |
|---|---|---|---|---|---|
| | Characteristics of | Coating performance | | Characterisics of chemical conversion solution | |
| | chemical conversion film Deposit amount of (A) mmol/m$^2$ | Coating adhesion Number of boxes | Corrosion resistance mm | Initial | Sludge generation 40° C., after 48 hrs. |
| Ex. 1 | 0.4 | 100 | 0.3 | Clear | Clear |
| Ex. 2 | 0.6 | 100 | 0.4 | Clear | Clear |
| Ex. 3 | 0.5 | 100 | 0.2 | Clear | Clear |
| Ex. 4 | 0.7 | 100 | 0.4 | Clear | Clear |
| Ex. 5 | 0.5 | 100 | 0.4 | Clear | Clear |
| Ex. 6 | 0.5 | 100 | 0.3 | Clear | Clear |
| Ex. 7 | 0.6 | 100 | 0.4 | Clear | Clear |
| Ex. 8 | 0.3 | 100 | 0.3 | Clear | Clear |
| Ex. 9 | 1.1 | 100 | 0.3 | Clear | Clear |
| Ex. 10 | 0.5 | 100 | 0.2 | Clear | Clear |
| Ex. 11 | 1.0 | 100 | 0.3 | Clear | Clear |
| Ex. 12 | 0.6 | 100 | 0.3 | Clear | Clear |
| Comp. | 0.1 | 98 | 0.9 | White turbid | Sludge generated |
| Comp. | 0.1 | 95 | 0.8 | White turbid | Sludge generated |
| Comp. | 0.0 | 90 | 0.9 | Clear | Clear |
| Comp. | 0.1 | 95 | 0.8 | White turbid | Sludge generated |
| Comp. | 0.0 | 88 | 1.0 | Clear | Clear |
| Comp. | 0.1 | 40 | 1.5 | Clear | Clear |
| Comp. | 0.4 | 100 | 0.2 | Clear | Clear |
| Comp. | 0.4 | 100 | 0.2 | Clear | Clear |
| Comp. | 0.4 | 100 | 0.3 | Clear | Clear |
| Comp. | | 100 | 0.2 | Clear | Clear |
| Comp. | | 100 | 0.4 | Clear | Clear |
| Comp. | | 100 | 0.6 | Clear | Clear |

The invention claimed is:

1. A chromium- and fluorine-free chemical conversion treatment solution for metal surfaces, comprising:

from 0.5 to 10 mmol/L of at least one water-soluble titanium and/or zirconium compound (A);

at least one organic compound (B) having two or three functional groups as a stabilizer for the water soluble compound (A);

wherein the content of organic compound (B) is from 2.5 to 10 times higher than the zirconium and titanium content of compound (A) on a mole basis; and at least one non-ionic surfactant;

wherein the pH of the chemical conversion treatment solution falls within the range of 2.0 to 6.5.

2. The chemical conversion treatment solution of claim 1, wherein water-soluble compound(s) (A) are present in an amount of from 0.5 to 5.5 mmol/L.

3. The chemical conversion treatment of claim 1, wherein water-soluble compound(s) (A) are present in an amount of 0.5 to 5 mmol/L.

4. The chemical conversion treatment solution of claim 1, wherein the mol ratio of organic compound (B) to metal of compound(s) (A) is from 2.5 to 9.

5. The chemical conversion treatment of claim 4, wherein water-soluble compound(s) (A) are present in an amount of 0.5 to 5 mmol/L.

6. The chemical conversion treatment solution for metal surfaces of claim 1, wherein the functional groups of the organic compound (B) are selected from the group consisting of hydroxy groups, carboxyl groups, amino groups, phosphonic acid groups, and mixtures thereof.

7. The chemical conversion treatment solution of claim 1, wherein the organic compound (B) contains at least one phosphonic acid group.

8. The chemical conversion treatment solution for metal surfaces according to claim 1, wherein the organic compound (B) is at least one organic compound selected from the group consisting of an organic compound having one carboxyl group and one hydroxy group in one molecule; an organic compound having one carboxyl group and one amino group in one molecule; an organic compound having one carboxyl group and two amino groups in one molecule; an organic compound having two carboxyl groups and one amino group in one molecule; an organic compound having two carboxyl groups and one hydroxy group in one molecule; an organic compound having two phosphonic acid groups and one hydroxy group in one molecule; and/or a salt thereof.

9. The chemical conversion treatment solution for metal surfaces according to claim 8, wherein the organic compound having one carboxyl group and one hydroxy group in one molecule is glycolic acid, lactic acid or salicylic acid, the organic compound having one carboxyl group and one amino group in one molecule is glycine or alanine, the organic compound having one carboxyl group and two amino groups in one molecule is asparagine, the organic compound having two carboxyl groups and one amino group in one molecule is aspartic acid or glutamic acid, the organic compound having two carboxyl groups and one hydroxy group in one molecule is malic acid, and the organic compound having two phosphonic acid groups and one hydroxy group in one molecule is 1-hydroxyethylidene-1, 1-diphosphonic acid.

10. The chemical conversion treatment solution for metal surfaces of claim 1, further comprising metal ions (C) of at least one metal selected from the group consisting of aluminum, zinc, magnesium, calcium, copper, tin, iron, nickel, cobalt, manganese, indium, yttrium, tellurium, cerium and lanthanum, in a total amount of from 2 to 5000 ppm by weight based on the total weight of the chemical conversion treatment solution.

11. The chemical conversion treatment solution for metal surfaces of claim 1, further comprising metal ions (C) of at least one metal selected from the group consisting of nickel, cobalt, manganese, yttrium, tellurium, and lanthanum, in a total amount of from 2 to 5000 ppm by weight based on the total weight of the chemical conversion treatment solution.

12. The chemical conversion treatment solution for metal surfaces of claim 1, further comprising at least one silicon compound (D) in an amount of 0.02 to 20 mmol/L.

13. The chemical conversion treatment solution for metal surfaces of claim 5, further comprising at least one silicon compound (D) in an amount of 0.02 to 20 mmol/L.

14. The chemical conversion treatment solution for metal surfaces of claim 1, further comprising at least one silicon compound (D) in an amount of 0.02 to 0.4 mmol/L.

15. The chemical conversion treatment solution for metal surfaces of claim 1, further comprising at least one cationic water-soluble resin (E) selected from the group consisting of water-soluble oligomers containing free amino groups and water-soluble polymers containing free amino groups, in an amount of 0.001 to 1 mmol/L.

16. The chemical conversion treatment solution for metal surfaces of claim 13, further comprising at least one cationic water-soluble resin (E) selected from the group consisting of water-soluble oligomers containing free amino groups and water-soluble polymers containing free amino groups, in an amount of 0.001 to 1 mmol/L.

17. The chemical conversion treatment of claim 1, wherein the mol ratio of organic compound (B) to metal of compound(s) (A) is from 3 to 8.

18. A fluorine- and chromium-free method for treating metal surfaces, comprising:

conducting electrolysis on a surface of a structure constructed of at least one metal surface selected from the group consisting of cold-rolled steel, aluminum, aluminum alloy, galvanized steel, and alloyed galvanized steel and, contacting the at least one metal surface with the chemical conversion treatment solution for metal surfaces of claim 1, with the metal serving as a cathode, to thereby form a chemical conversion film directly on the surface.

19. A fluorine- and chromium-free method for treating metal surfaces, comprising:

bringing the chemical conversion treatment solution for metal surfaces of claim 1 into contact with a metallic material not previously treated, so as to carry out degreasing and chemical conversion of the metallic material at one time.

20. A chromium- and fluorine-free chemical conversion treatment solution for metal surfaces of claim 1, consisting essentially of:

from 0.1 to 10 mmol/L of water-soluble titanium and/or zirconium compounds (A), and at least one organic compound (B) with two to three functional groups as a stabilizer, the organic compound (B) content being 2.5 to 9 times as high as a metal content of the compound(s) (A) on a mole basis;

optionally one or more silicon compounds selected from the group consisting of silane coupling agents and colloidal silicas, in an amount of 0.02 to 20 mmol/L;

optionally, one or more cationic water-soluble resins selected from the group consisting of water-soluble oligomers containing free amino groups and water-soluble polymers containing free amino groups, in an amount of 0.001 to 1 mmol/L; and one or more nonionic surfactants;

and optionally, a base and/or acid to adjust the solution pH; wherein the pH of the chemical conversion treatment solution is within the range of 2.0 to 6.5.

21. The chromium and fluorine-free chemical conversion treatment solution of claim 20, wherein when an acid is added to adjust the pH, the acid is selected from the group consisting of sulfuric acid, hydrochloric acid, acetic acid, and mixtures thereof.

22. A chromium- and fluorine-free chemical conversion treatment solution for metal surfaces of claim 1, comprising:

at least one water-soluble titanium and/or water-soluble zirconium compound, present in an amount of 0.5 to 5 mmol/L;

at least one organic compound (B), having two to three functional groups as a stabilizer, the content of organic compound (B) being 2.5 to 10 times higher than the zirconium and titanium content of compound(s) (A) on a mole basis;

metal ions (C) of at least one metal selected from the group consisting of aluminum, zinc, magnesium, calcium, copper, tin, iron, nickel, cobalt, manganese, indium, yttrium, tellurium, cerium and lanthanum, in a total amount of from 2 to 5000 ppm based on the total weight of the chemical conversion treatment solution;

the pH of the chemical conversion treatment solution being within the range of 2.0 to 6.5;

wherein a chemical conversion film containing an oxide or hydroxide of titanium and/or zirconium is formed on the metal surface.

23. A fluorine- and chromium-free method for treating metal surfaces comprising:

treating a metallic base material surface of a structure constructed of at least one of cold-rolled steel; aluminum, aluminum alloy; galvanized steel, and/or alloyed galvanized steel, by contacting the metallic base material surface with the chemical conversion treatment solution for metal surfaces of claim 1, and forming a chemical conversion film directly on the metallic base material surface.

24. A fluorine- and chromium-free method for treating metal surfaces comprising:

A) cleaning a surface of a structure constructed of at least one of cold-rolled steel, aluminum, aluminum alloy, zinc, zinc alloy, galvanized steel, and alloyed galvanized steel with an alkaline cleaning solution to generate an as cleaned surface;

B) rinsing the as cleaned surface with water; and

C) contacting the as cleaned surface, after water rinsing, with a chemical conversion treatment solution of claim 1, and producing a chemical conversion film on the surface.

25. A chromium- and fluorine-free chemical conversion treatment solution for metal surfaces of claim 1, consisting essentially of:

from 0.1 to 10 mmol/L of water-soluble titanium and/or zirconium compounds (A), and at least one organic compound (B) with two to three functional groups as a stabilizer, the organic compound (B) content being 2.5 to 9 times as high as a metal content of the compound(s) (A) on a mole basis;

at least one cationic water-soluble resin selected from the group consisting of water-soluble oligomers containing free amino groups and water-soluble polymers containing free amino groups, in an amount of 0.001 to 1 mmol/L; and one or more nonionic surfactants;

optionally one or more pH adjusting acids or bases;

the pH of the chemical conversion treatment solution being within the range of 2.0 to 6.5, wherein the solution degreases and chemically converts the metal surface at the same time.

26. A chromium- and fluorine-free chemical conversion treatment solution for metal surfaces, consisting essentially of:

from 0.5 to 5.5 mmol/L of at least one water-soluble titanium and/or water-soluble zirconium compound (A);

at least one organic compound (B) having two or three functional groups as a stabilizer for the water soluble compound (A);

wherein the content of organic compound (B) is from 2.5 to 10 times higher than the zirconium and titanium content of compound (A) on a mole basis;

at least one non-ionic surfactant; and optionally, one or more pH adjusting acids or bases;

wherein the pH of the chemical conversion treatment solution falls within the range of 2.0 to 6.5.

27. The chemical conversion treatment solution of claim 26, wherein water-soluble compound(s) (A) are present in an amount of from 0.5 to 5 mmol/L.

* * * * *